US009800978B2

(12) United States Patent
Noertker et al.

(10) Patent No.: US 9,800,978 B2
(45) Date of Patent: Oct. 24, 2017

(54) AUDIO DRIVER ASSEMBLIES, HEADPHONES INCLUDING THE AUDIO DRIVER ASSEMBLIES, AND RELATED METHODS

(71) Applicant: Skullcandy, Inc., Park City, UT (US)

(72) Inventors: Sam Noertker, Park City, UT (US); John Timothy, Salt Lake City, UT (US); Randall J. Hull, Park City, UT (US); Sam Lepley, Park City, UT (US); Matthew Windt, Heber City, UT (US); Gregory R. Woolston, Salt Lake City, UT (US)

(73) Assignee: Skullcandy, Inc., Park City, UT (US)

( * ) Notice: Subject to any disclaimer, the term of this patent is extended or adjusted under 35 U.S.C. 154(b) by 0 days.

(21) Appl. No.: 14/974,815

(22) Filed: Dec. 18, 2015

(65) Prior Publication Data

US 2016/0192076 A1 Jun. 30, 2016

Related U.S. Application Data

(60) Provisional application No. 62/099,010, filed on Dec. 31, 2014.

(51) Int. Cl.

| | |
|---|---|
| ***H04R 9/02*** | (2006.01) |
| ***H04R 1/10*** | (2006.01) |
| ***H04R 9/04*** | (2006.01) |
| ***H04R 11/02*** | (2006.01) |

(52) U.S. Cl.

CPC ..... *H04R 9/025* (2013.01); *H04R 1/1008* (2013.01); *H04R 1/1075* (2013.01); *H04R 9/027* (2013.01); *H04R 9/045* (2013.01); *H04R 11/02* (2013.01)

(58) Field of Classification Search

CPC ..... H04R 1/02; H04R 1/025; H04R 1/026; H04R 9/00; H04R 9/022; H04R 9/025; H04R 9/027; H04R 7/00; H04R 2207/00; H04R 7/04

USPC ..... 381/386, 396, 397, 412–414, 423, 431

See application file for complete search history.

(56) References Cited

U.S. PATENT DOCUMENTS

| | | | |
|---|---|---|---|
| 3,798,393 | A | 3/1974 | Gorike |
| 6,023,515 | A | 2/2000 | McKee et al. |
| 8,199,955 | B2 | 6/2012 | Akino |
| 8,442,258 | B2 | 5/2013 | Kimura |
| 2002/0025052 | A1 | 2/2002 | Gotoh et al. |
| 2004/0008858 | A1 | 1/2004 | Steere et al. |
| 2007/0223718 | A1 | 9/2007 | Felder et al. |

(Continued)

FOREIGN PATENT DOCUMENTS

| | | | |
|---|---|---|---|
| WO | 2007018657 | A2 | 2/2007 |
| WO | 2008064022 | A2 | 5/2008 |

OTHER PUBLICATIONS

Price, Rex, U.S. Appl. No. 14/802,360 entitled Mass Port Plug for Customizing Headphone Drivers, and Related Methods, filed Jul. 17, 2015.

(Continued)

*Primary Examiner* — Suhan Ni
(74) *Attorney, Agent, or Firm* — TraskBritt

(57) ABSTRACT

An audio driver assembly comprises a driver housing and an audio driver secured within the driver housing. The audio driver comprises a magnet assembly, a flexible diaphragm overlying the magnet assembly, and a stabilizer extending through the driver housing and into the magnet assembly. A headphone and a method of forming a headphone are also described.

17 Claims, 5 Drawing Sheets

(56) References Cited

U.S. PATENT DOCUMENTS

| | | | |
|---|---|---|---|
| 2008/0170710 | A1 | 7/2008 | Pasternak |
| 2011/0188696 | A1 | 8/2011 | Kimura |
| 2011/0243370 | A1 | 10/2011 | Wang |
| 2012/0114160 | A1 | 5/2012 | Lin |
| 2014/0270228 | A1 | 9/2014 | Oishi et al. |

OTHER PUBLICATIONS

European Search Report for European Application No. 15202031 dated Mar. 7, 2016, 8 pages.

AUDIO DRIVER ASSEMBLIES, HEADPHONES INCLUDING THE AUDIO DRIVER ASSEMBLIES, AND RELATED METHODS

CROSS-REFERENCE TO RELATED APPLICATION

This application claims the benefit of U.S. Provisional Patent Application Ser. No. 62/099,010, filed Dec. 31, 2014, the disclosure of which is hereby incorporated herein in its entirety by this reference.

FIELD

The disclosure, in various embodiments, relates generally to audio driver assemblies, to headphones including audio driver assemblies, and to related methods of forming headphones. More specifically, embodiments of the disclosure relate to audio driver assemblies including a driver housing, an audio driver, and a stabilizer extending through the driver housing and into a magnet assembly, to headphones including such audio driver assemblies, and to methods of forming such headphones.

BACKGROUND

Conventional headphones include two ear-cup housings each including an audio driver assembly having an audio driver that produces audible sound waves. The audio driver may, for example, include a magnet/coil assembly secured within a driver housing, and a flexible diaphragm adjacent the magnet/coil assembly and attached to the driver housing. The positive and negative electrical terminals for the audio driver are respectively soldered to ends of wires, which extend to an audio jack (e.g., a tip-sleeve (TS) connector, a tip-ring-sleeve (TRS) connector, a tip-ring-ring-sleeve (TRRS) connector, etc.). The audio jack may be coupled to a media player such as a mobile phone, a digital media player, a computer, a television, etc., and the audio signal is transmitted to the audio driver in the audio driver assembly within the headphone through the wires.

The acoustic performance of a headphone is conventionally a function of both the audio driver, as well as the configuration of the audio driver assembly and the ear-cup housing within which the audio driver is disposed. The audio driver assembly and the ear-cup housing of conventional headphones typically define acoustical cavities that affect the acoustics of the headphone. Thus, the manufacturer of the headphones may design the ear-cup housing and audio driver assembly of a headphone for use with a selected audio driver, so as to provide the headphone with acoustics deemed desirable by the manufacturer.

BRIEF SUMMARY

In accordance with one embodiment described herein, an audio driver assembly comprises a driver housing and an audio driver secured within the driver housing. The audio driver comprises a magnet assembly, a flexible diaphragm overlying the magnet assembly, and a stabilizer extending through the driver housing and into the magnet assembly.

In additional embodiments, a headphone comprises an ear-cup housing and an audio driver assembly disposed at least partially within the ear-cup housing. The audio driver assembly comprises a driver housing, a flexible diaphragm suspended from the driver housing, a magnet assembly underlying the diaphragm, and a stabilizer extending through the driver housing and into the magnet assembly. The magnet assembly comprises a permanent magnet, a voice coil circumscribing the permanent magnet, and a yoke cup at least partially surrounding the permanent magnet and the voice coil.

In additional embodiments, a method of forming a headphone comprises forming an audio driver assembly, and attaching the audio driver assembly within an ear-cup housing. The audio driver assembly comprises a driver housing, a flexible diaphragm suspended from the driver housing, a magnet assembly underlying the diaphragm, and a stabilizer extending through the driver housing and into the magnet assembly. The magnet assembly comprises a permanent magnet, a voice coil circumscribing the permanent magnet, and a yoke cup at least partially surrounding the permanent magnet and the voice coil.

DETAILED DESCRIPTION

Figure 1:
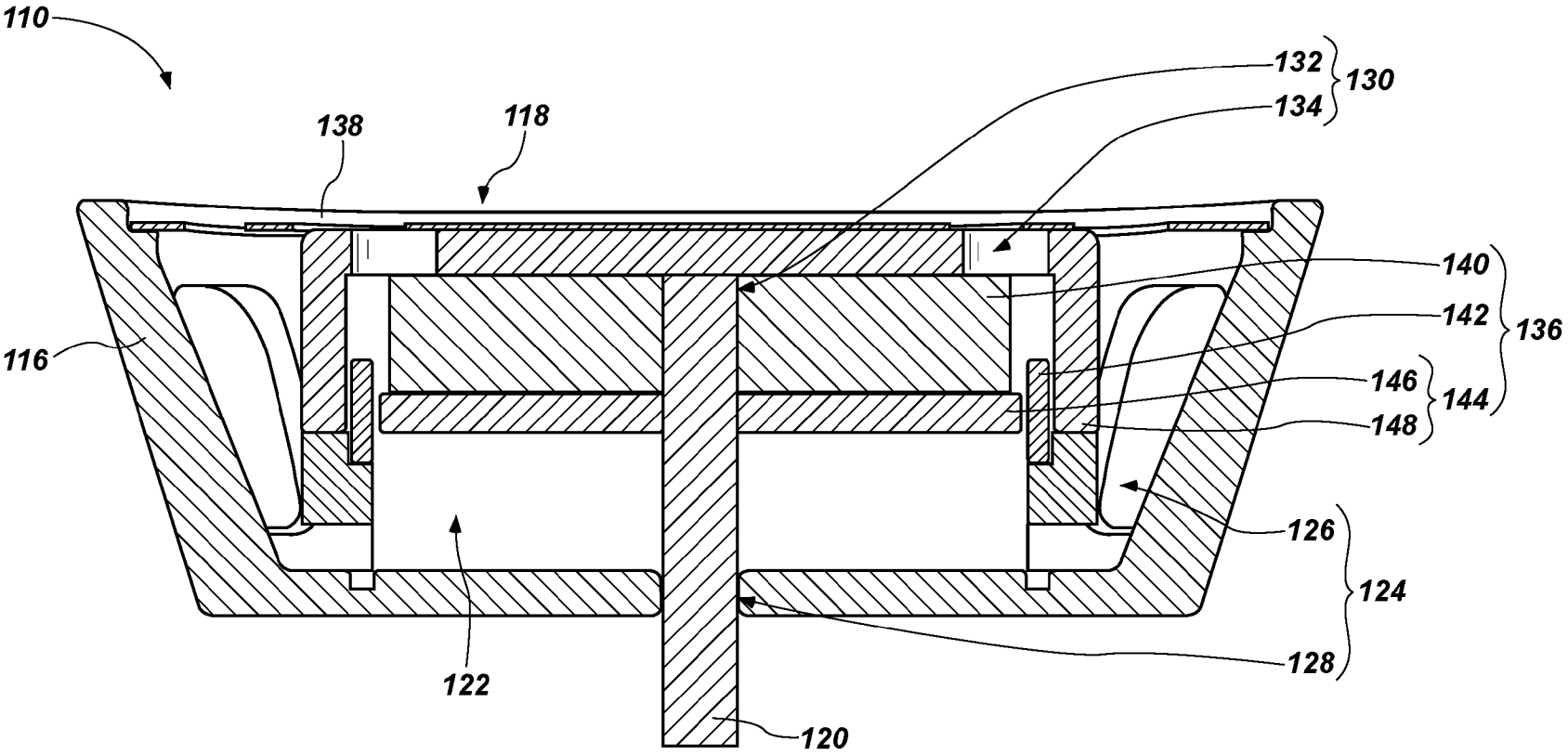
FIG. 1 is a simplified cross-sectional side view illustrating an audio driver assembly of the ear-cup assembly, in accordance with an embodiment of disclosure.

Audio driver assemblies are disclosed, as are headphones including audio driver assemblies, and methods of forming headphones. In some embodiments, an audio driver assembly includes a driver housing, an audio driver secured within driver housing, and a stabilizer extending through the driver housing and into the audio driver. The audio driver may comprise a magnet assembly and a flexible diaphragm overlying the magnet assembly. The stabilizer is configured and positioned to impede or prevent lateral movement of one or more components of the magnet assembly, reducing the risk of damage to the audio driver that may otherwise result from such lateral movement. In additional embodiments, the audio driver assembly may also include a vibration dampener disposed between the driver housing and the stabilizer. The vibration dampener may be configured and positioned to reduce the vibration amplitude at resonance of one or more components of audio driver assembly.

The following description provides specific details, such as material compositions and processing conditions, in order to provide a thorough description of embodiments of the present disclosure. However, a person of ordinary skill in the art would understand that the embodiments of the disclosure may be practiced without employing these specific details. Indeed, the embodiments of the disclosure may be practiced in conjunction with conventional audio driver assembly fabrication techniques employed in the industry. In addition, the description provided below does not form a complete process flow for manufacturing an audio driver assembly or audio device (e.g., headphone). Only those process acts and structures necessary to understand the embodiments of the disclosure are described in detail below. Additional acts to form a complete audio device from the structures and assemblies described herein may be performed by conventional fabrication processes.

Drawings presented herein are for illustrative purposes only, and are not meant to be actual views of any particular material, component, structure, device, or system. Variations from the shapes depicted in the drawings as a result, for example, of manufacturing techniques and/or tolerances, are to be expected. Thus, embodiments described herein are not to be construed as being limited to the particular shapes or regions as illustrated, but include deviations in shapes that result, for example, from manufacturing. For example, a region illustrated or described as box-shaped may have rough and/or nonlinear features, and a region illustrated or described as round may include some rough and/or linear features. Moreover, sharp angles that are illustrated may be rounded, and vice versa. Thus, the regions illustrated in the figures are schematic in nature, and their shapes are not intended to illustrate the precise shape of a region and do not limit the scope of the present claims. The drawings are not necessarily to scale. Additionally, elements common between figures may retain the same numerical designation.

As used herein, the terms "comprising," "including," "containing," "characterized by," and grammatical equivalents thereof are inclusive or open-ended terms that do not exclude additional, unrecited elements or method steps, but also include the more restrictive terms "consisting of" and "consisting essentially of" and grammatical equivalents thereof. As used herein, the term "may" with respect to a material, structure, feature or method act indicates that such is contemplated for use in implementation of an embodiment of the disclosure and such term is used in preference to the more restrictive term "is" so as to avoid any implication that other, compatible materials, structures, features and methods usable in combination therewith should or must be, excluded.

As used herein, the singular forms "a," "an," and "the" are intended to include the plural forms as well, unless the context clearly indicates otherwise.

As used herein, "and/or" includes any and all combinations of one or more of the associated listed items.

As used herein, spatially relative terms, such as "beneath," "below," "lower," "bottom," "above," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures. For example, if materials in the figures are inverted, elements described as "below" or "beneath" or "under" or "on bottom of" other elements or features would then be oriented "above" or "on top of" the other elements or features. Thus, the term "below" can encompass both an orientation of above and below, depending on the context in which the term is used, which will be evident to one of ordinary skill in the art. The materials may be otherwise oriented (e.g., rotated 90 degrees, inverted, flipped) and the spatially relative descriptors used herein interpreted accordingly.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" in reference to a given parameter is inclusive of the stated value and has the meaning dictated by the context (e.g., it includes the degree of error associated with measurement of the given parameter).

FIG. 1 is a simplified cross-sectional view illustrating an audio driver assembly 110, in accordance with an embodiment of the disclosure. The audio driver assembly 110 includes a driver housing 116, an audio driver 118 secured within the driver housing 116, and a stabilizer 120 extending through the driver housing 116 and into the audio driver 118. While FIG. 1 depicts a particular configuration of the audio driver assembly 110, one of ordinary skill in the art will appreciate that different audio driver assembly configurations are known in the art which may be adapted to be employed in embodiments of the disclosure. FIG. 1 illustrates just one non-limiting example of the audio driver assembly 110.

The driver housing 116 may be configured to be secured within an outer ear-cup housing of an ear-cup assembly, and includes at least one structure configured to at least partially enclose and support the audio driver 118. The driver housing 116 may be positioned over one or more sides (e.g., at least a back side) of the audio driver 118. An acoustical cavity 122 may be disposed between the driver housing 116 and the one or more sides of the audio driver 118. The driver housing 116 may also exhibit one or more apertures 124 (e.g., ports, holes, etc.) extending therethrough. The location and configuration (e.g., size, shape, etc.) of the apertures 124 may be selected to provide a desired emitted sound pressure level (SPL) profile, and/or a desired detectable SPL profile, for the audio driver assembly 110 and a headphone including the audio driver assembly 110. The apertures 124 in the driver housing 116 may, for example, include at least one bottom aperture 128 extending through a bottom portion of the driver housing 116, and at least one side aperture 126 extending through a side portion of the driver housing 116. As shown in FIG. 1, the bottom aperture 128 may be centrally positioned within the bottom portion of the driver housing 116, and the side aperture 126 may be positioned within the side portion of the driver housing 116. At least one of the apertures 124 in the driver housing 116 may be at least partially (e.g., substantially) aligned with at least one aperture in the audio driver 118. By way of non-limiting example, the bottom aperture 128 of the driver housing 116 may be substantially aligned with a centrally located aperture 132 of the audio driver 118. The stabilizer 120 may be positioned within the bottom aperture 128 of the driver housing 116 and the centrally located aperture 132 of the audio driver 118, as described in further detail below. The driver housing 116 may be formed of and include at least one of a metal material (e.g., a metal, a metal alloy, etc.) and a polymer material (e.g., a plastic).

The audio driver 118 includes a magnet/coil assembly 136 and a flexible diaphragm 138 overlying the magnet/coil assembly 136. One or more components (e.g., the magnet/coil assembly 136, the flexible diaphragm 138, etc.) of the audio driver 118 may be coupled (e.g., directly coupled, indirectly coupled, or a combination thereof) to one or more portions of the driver housing 116 using, for example, an adhesive, a snap-fit, a welding process, or any other suitable method.

The magnet/coil assembly 136 may include a permanent magnet 140, a voice coil 142 circumscribing the permanent magnet 140, and a yoke cup 144 at least partially surrounding the permanent magnet 140 and the voice coil 142. As shown in FIG. 1, the permanent magnet 140 may be located on (e.g., directly physically contact, abut, etc.) a lower portion 146 of the yoke cup 144, and an upper portion 148 of the yoke cup 144 may be located on an upper surface of the permanent magnet 140. The upper portion 148 of the yoke cup 144 may at least partially extend over and surround (e.g., cover, envelop, etc.) peripheral sidewalls (e.g., outer sidewalls) of each of the permanent magnet 140 and the lower portion 146 of the yoke cup 144. At least a portion of the voice coil 142 may be located within a cavity at least partially defined by inner sidewalls of the upper portion 148 of the yoke cup 144 and the peripheral sidewalls of each of the permanent magnet 140 and the lower portion 146 of the yoke cup 144. The voice coil 142 may be offset (e.g., spaced apart, separated, etc.) from each of the permanent magnet 140 and the yoke cup 144, and may be electrically coupled to conductive terminals of the audio driver 118. The voice coil 142 and the yoke cup 144 may each independently be formed of and include an electrically conductive material, such as a metal material (e.g., a metal, a metal alloy, etc.). In addition, as depicted in FIG. 1, one or more apertures 130 (e.g., ports, holes, etc.) may at least partially extend through the magnet/coil assembly 136. The apertures 130 in the magnet/coil assembly 136 may, for example, include the centrally located aperture 132, and one or more non-centrally located apertures 134. As shown in FIG. 1, the centrally located aperture 132 may extend through the lower portion 146 of the yoke cup 144 and the permanent magnet 140 to the upper portion 148 of the yoke cup 144, and the non-centrally located apertures 134 may extend through at least the upper portion 148 of the yoke cup 144. A width of the centrally located aperture 132 may be substantially the same as or may be different than (e.g., less than, greater than) a width of the bottom aperture 128 of the driver housing 116 thereunder. The stabilizer 120 may be partially disposed within the centrally located aperture 132 (as well as the bottom aperture 128 of the driver housing 116), and may physically contact a lower surface of the upper portion 148 of the yoke cup 144, as described in further detail below.

The flexible diaphragm 138 may be positioned on or over the upper portion 148 of the yoke cup 144 of the magnet/coil assembly 136. At least a peripheral portion (e.g., an outer rim) of the flexible diaphragm 138 may be attached (e.g., coupled, bonded, adhered, connected, etc.) to the driver housing 116. A central portion of the flexible diaphragm 138 may be attached to the upper portion 148 of the yoke cup 144. The flexible diaphragm 138 may be configured to vibrate in accordance with movement of one or more components (e.g., the permanent magnet 140 and the yoke cup 144) of the magnet/coil assembly 136 responsive to a magnetic field produced by the voice coil 142 of the magnet/coil assembly 136 upon receiving an audio signal. In some embodiments, the flexible diaphragm 138 is formed of and includes a polymer material (e.g., a plastic).

The stabilizer 120 is positioned and configured to limit lateral movement (e.g., side-to-side movement, rocking movement, etc.) of one or more components of the magnet/coil assembly 136, while also permitting longitudinal movement (e.g., upward movement and downward movement) of the one or more components of the magnet/coil assembly 136. As used herein, each of the terms "lateral" and "horizontal" means and includes extending in a direction substantially parallel to at least the flexible diaphragm 138, regardless of the orientation of the flexible diaphragm 138. Accordingly, each of the terms "longitudinal" and "vertical" means and includes extending in a direction substantially perpendicular to at least the flexible diaphragm 138, regardless of the orientation of the flexible diaphragm 138. For example, the stabilizer 120 may be positioned and configured to substantially limit lateral movement of at least the permanent magnet 140 and the yoke cup 144, while permitting longitudinal movement of at least the permanent magnet 140 and the yoke cup 144. Limiting the lateral movement of the one or more components of the magnet/coil assembly 136 using the stabilizer 120 may prevent damage to the magnet/coil assembly 136 (and, hence, the audio driver 118) that may otherwise occur if the stabilizer 120 was not present in the audio driver assembly 110. By way of non-limiting example, the stabilizer 120 may prevent damage to (e.g., breakage of) the voice coil 146 that may otherwise occur if lateral movement of the permanent magnet 140 and the yoke cup 144 were unimpeded. Such unimpeded lateral movement may, for example, occur if a headphone including a conventional audio driver assembly were dropped and/or suddenly moved (e.g., jerked). The position and configuration (e.g., shape, size, and material composition) of the stabilizer 120 may be selected relative to positions and configurations of other components of the audio driver assembly 110 to provide the audio driver assembly 110 with desired acoustic properties, as described in further detail below.

The stabilizer 120 longitudinally extends through driver housing 116, the acoustical cavity 122, and at least a portion of the magnet/coil assembly 136. The stabilizer 120 may also be substantially centrally located relative to widths (e.g., diameters) of the driver housing 116, the magnet/coil assembly 136, and the flexible diaphragm 138. By way of non-limiting example, as shown in FIG. 1, the stabilizer 120 may longitudinally extend from a location outside of the driver housing 116 through each of the bottom aperture 128 of the driver housing 116, the acoustical cavity 122, and the centrally located aperture 132 of the magnet/coil assembly 136, and may terminate (e.g., stop, end, etc.) at the upper portion 148 of the yoke cup 144. In additional embodiments, the stabilizer 120 may longitudinally extend to and terminate at a different location within the magnet/coil assembly 136 (e.g., at an upper surface of the upper portion 148 of the yoke cup 144, at a location within the upper portion 148 of the yoke cup 144, at a location within the permanent magnet 140, at an upper surface of the lower portion 146 of the yoke cup 144, at a location within the lower portion 146 of the yoke cup 144, etc.).

The stabilizer 120 may exhibit a lateral cross-sectional shape that complements the lateral cross-sectional shape of each of the centrally located aperture 132 of the magnet/coil assembly 136 and the bottom aperture 128 of the driver housing 116. By way of non-limiting example, the stabilizer 120, the centrally located aperture 132 of the magnet/coil assembly 136 and the bottom aperture 128 of the driver housing 116 may each exhibit a substantially circular lateral cross-sectional shape. In addition, the stabilizer 120 may exhibit one or more lateral cross-sectional dimensions (e.g., diameters, widths, etc.) permitting the stabilizer 120 to substantially laterally extend between one or more surfaces defining the centrally located aperture 132 of the magnet/coil assembly 136, and to at least partially (e.g., substantially) laterally extend between one or more surfaces defining the bottom aperture 128 of the driver housing 116. In addition, the stabilizer 120 may exhibit a longitudinal cross-sectional dimension (e.g., height) permitting the stabilizer 120 to longitudinally extend beyond the lower surface of the driver housing 116.

The stabilizer 120 may be formed of and include at least one of a polymer material (e.g., a plastic) and metal material (e.g., a metal, a metal alloy, etc.). The material composition of the stabilizer 120 may be selected to provide the stabilizer 120 with properties (e.g., flexure, stiffness, etc.) sufficient to substantially impede or prevent lateral movement of one or more components of the magnet/coil assembly 136 (e.g., the permanent magnet 140 and the yoke cup 144), and may also be selected to provide the audio driver assembly 110 with desired acoustic properties. As a non-limiting example, a stabilizer 120 formed of and including a metal material may impede lateral movement of components of the magnet/coil assembly 136 and may also provide the audio driver 118 with relatively lower resonance than a stabilizer 120 formed of and including a polymer material (e.g., at least partially due to the relatively increased density of a metal material as compared to a polymer material). In some embodiments, the stabilizer 120 is formed of and includes a metal material.

The stabilizer 120 may be attached (e.g., adhered, bonded, coupled, etc.) to one or more surfaces (e.g., surfaces of at least one of the permanent magnet 140, the lower portion 146 of the yoke cup 144, and the upper portion 148 of the yoke cup 144) defining the centrally located aperture 132 of the magnet/coil assembly 136, and may be unattached (e.g., unadhered, unbonded, uncoupled, etc.) to surfaces defining the bottom aperture 128 of the driver housing 116. Accordingly, the stabilizer 120 may move longitudinally (e.g., move upward, move downward) in accordance with the longitudinal movement of one or more components (e.g., the permanent magnet 140 and the yoke cup 144) of the magnet/coil assembly 136. In additional embodiments, the stabilizer 120 may be attached to one or more surfaces defining the bottom aperture 128 of the driver housing 116, and may be unattached to surfaces defining the centrally located aperture 132 of the magnet/coil assembly 136. Accordingly, in such additional embodiments, the stabilizer 120 may remain substantially stationary during longitudinal movement of one or more components (e.g., the permanent magnet 140 and the yoke cup 144) of the magnet/coil assembly 136.

Optionally, a vibration dampener may be included in the audio driver assembly 110 at the location where the stabilizer 120 extends through the driver housing 116. The vibration dampener may intervene between the stabilizer 120 and the driver housing 116, and may be configured to reduce the vibration amplitude at resonance of one or more components of audio driver assembly 110 (e.g., the stabilizer 120; components the audio driver 118, such as the permanent magnet 140, the yoke cup 144, and the flexible diaphragm 138; etc.). The vibration dampener may facilitate a relatively more even (e.g., uniform) vibration response for the audio driver assembly 110 across a relatively wider range of frequencies.

Figure 2:
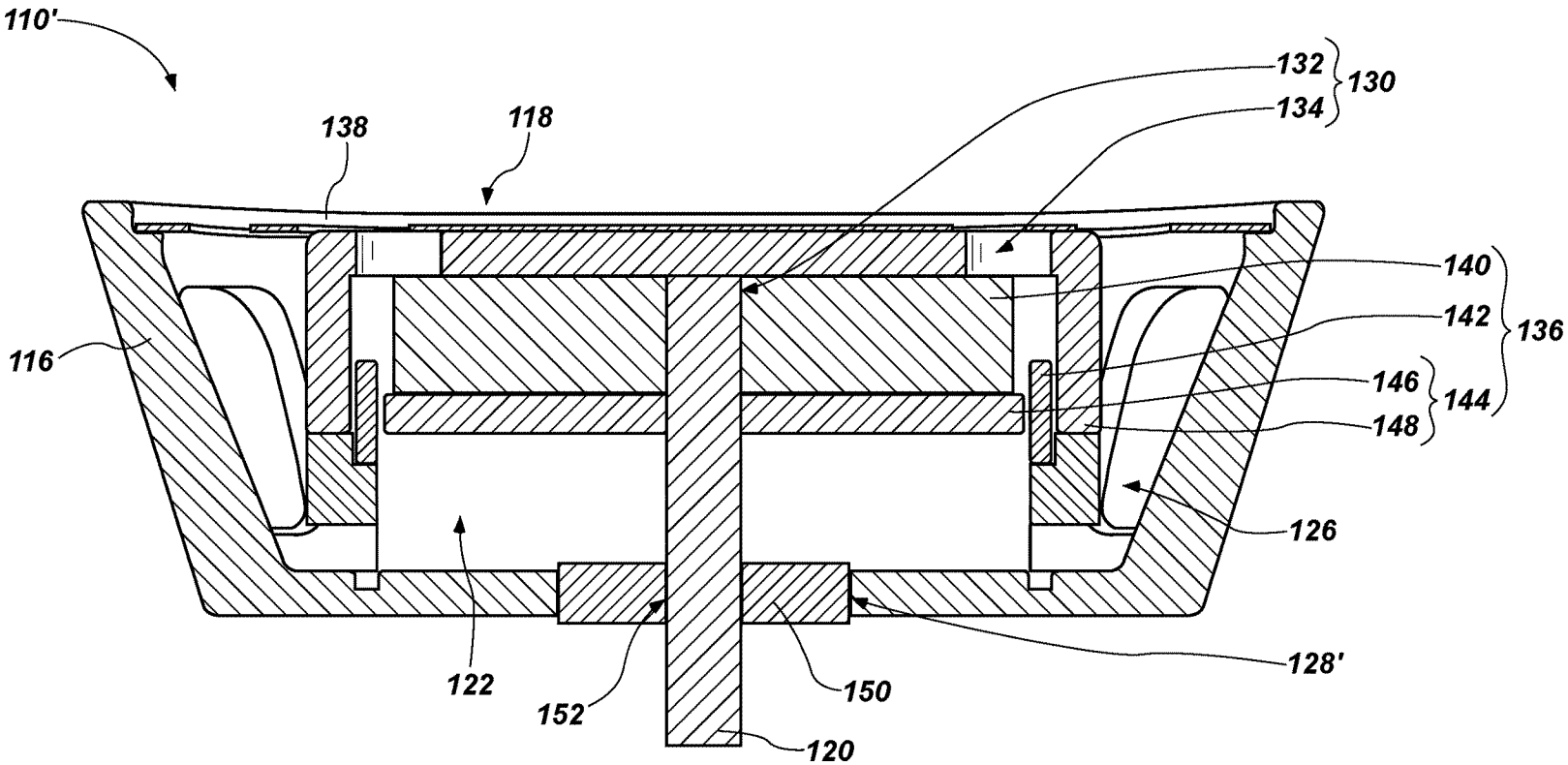
FIG. 2 is a simplified cross-sectional side view illustrating another audio driver assembly, in accordance with another embodiment of disclosure.

As a non-limiting example, FIG. 2 illustrates a simplified cross-sectional view of an audio driver assembly 110' including a vibration dampener 150, in accordance with another embodiment of the disclosure. The audio driver assembly 110' may be substantially similar to the audio driver assembly 110 previously described in relation to FIG. 1, except that the audio driver assembly 110' includes the vibration dampener 150 between the stabilizer 120 and the driver housing 116. The vibration dampener 150 may be configured to at least partially circumscribe and physically contact (e.g., abut) the stabilizer 120. For example, the vibration dampener 150 may comprise an annular structure surrounding and physically contacting sidewalls of the stabilizer 120. As shown in FIG. 2, the vibration dampener 150 may be disposed adjacent the driver housing 116 in a centrally located bottom aperture 128' extending through the driver housing 116. The centrally located bottom aperture 128' may be larger than the second, centrally located bottom aperture 128 previously described in relation to the audio driver assembly 110 in order to accommodate (e.g., at least partially contain) the vibration dampener 150. The vibration dampener 150 may exhibit a smaller, centrally located aperture 152 extending therethrough, wherein the centrally located aperture 152 is sized and shaped to receive and physically contact the stabilizer 120. The stabilizer 120 may be unattached to (e.g., unadhered to, unbonded to, etc.) surfaces of the vibration dampener 150 defining the centrally located aperture 152 (and attached to surfaces of the magnet/coil assembly 136 defining the centrally located aperture 132). At least friction resulting from the physical contact of the stabilizer 120 and the vibration dampener 150 may hinder longitudinal movement of the stabilizer 120 and reduce the vibration amplitude at resonance of the stabilizer 120 and one or more components of the audio driver 118 (e.g., the permanent magnet 140, the yoke cup 144, and the flexible diaphragm 138). The vibration dampener 150 may be formed of and include any material suitable for dampening vibration of the stabilizer 120 and the one or components of the audio driver 118. For example, the vibration dampener 150 may be formed of and include at least one of silicon, rubber, and foam. In some embodiments, the vibration dampener 150 comprises an annular foam structure.

Figure 3:
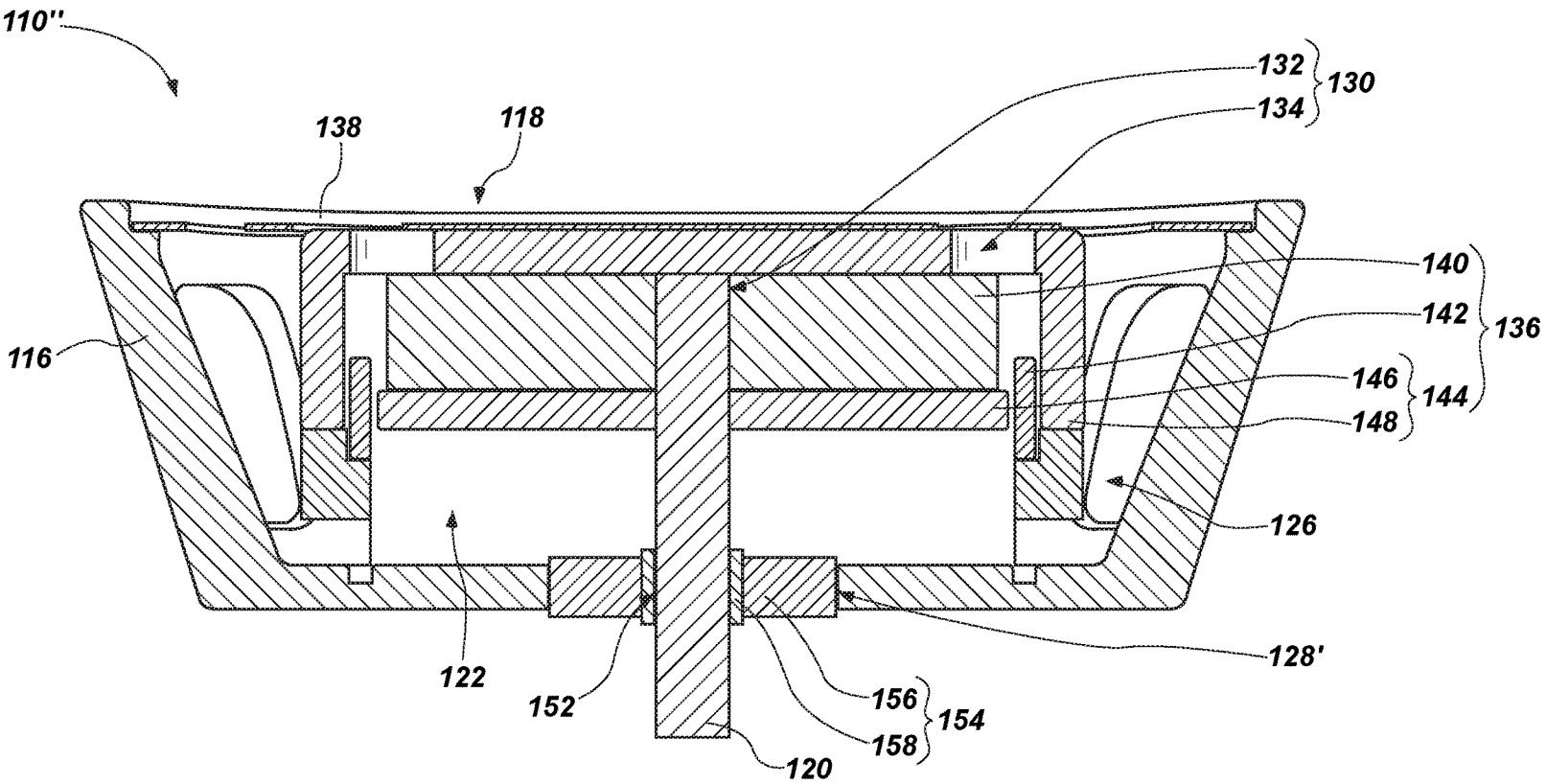
FIG. 3 is a simplified cross-sectional side view illustrating another audio driver assembly, in accordance with a further embodiment of disclosure.

In additional embodiments, the vibration dampener 150 may exhibit a different configuration than that depicted in FIG. 2. By way of non-limiting example, FIG. 3 illustrates a simplified cross-sectional view of an audio driver assembly 110" including a ferrofluidic vibration dampener 154, in accordance with another embodiment of the disclosure. The audio driver assembly 110" may be substantially similar to the audio driver assembly 110' previously described in relation to FIG. 2, except that the audio driver assembly 110" includes the ferrofluidic vibration dampener 154. As shown in FIG. 3, the ferrofluidic vibration dampener 154 at least partially circumscribes the stabilizer 120 and comprises a magnet assembly 156 adjacent the driver housing 116, and a ferrofluid 158 disposed between and physically contacting each of the magnet assembly 156 and the stabilizer 120. The magnet assembly 156 may be configured and operated to modify one or more properties of the ferrofluid 158 to control the amount (e.g., extent, degree, etc.) of dampening provided by the ferrofluidic vibration dampener 154. For example, the magnet assembly 156 may modify a magnetic field generated by a magnet thereof based at least partially on a current signal supplied to the magnet assembly 156 so as to polarize or depolarize ferromagnetic particles (e.g., iron oxide ($Fe_3O_4$) particles) of the ferrofluid 158. Polarizing the ferromagnetic particles may increase the viscosity of the ferrofluid 158 so as to increase the amount of dampening provided by the ferrofluidic vibration dampener 154. Namely, increasing the viscosity of the ferrofluid 158 in physical contact with the stabilizer 120 may hinder longitudinal movement of the stabilizer 120 and reduce the vibration amplitude at resonance of the stabilizer 120 and one or more components of the audio driver 118 (e.g., the permanent magnet 140, the yoke cup 144, and the flexible diaphragm 138). Conversely, depolarizing the ferromagnetic particles may decrease the viscosity of the ferrofluid 158 so as to decrease the amount of dampening provided by the ferrofluidic vibration dampener 154. The stabilizer 120 may be unattached to (e.g., unadhered to, unbonded to, etc.) surfaces of the ferrofluidic vibration dampener 154 (e.g., surfaces of defining the centrally located aperture 152), and attached to surfaces of the magnet/coil assembly 136 defining the centrally located aperture 132.

Referring collectively to FIGS. 1 through 3, in operation, current is caused to flow through the voice coil 142, the magnitude of which fluctuates according to the electrical signal carried by the current. The interaction between the magnetic field of the permanent magnet 140 and the fluctuating magnetic field generated by the current flowing through the voice coil 142 results in a upward and downward movement (i.e., vibration) of at least the diaphragm 138, permanent magnet 140 and the yoke cup 144 (and, optionally, the stabilizer 120) relative to the voice coil 142 and the driver housing 116. The vibrations of the flexible diaphragm 138 result in the emission of audible sound from the flexible diaphragm 138.

Figure 4:
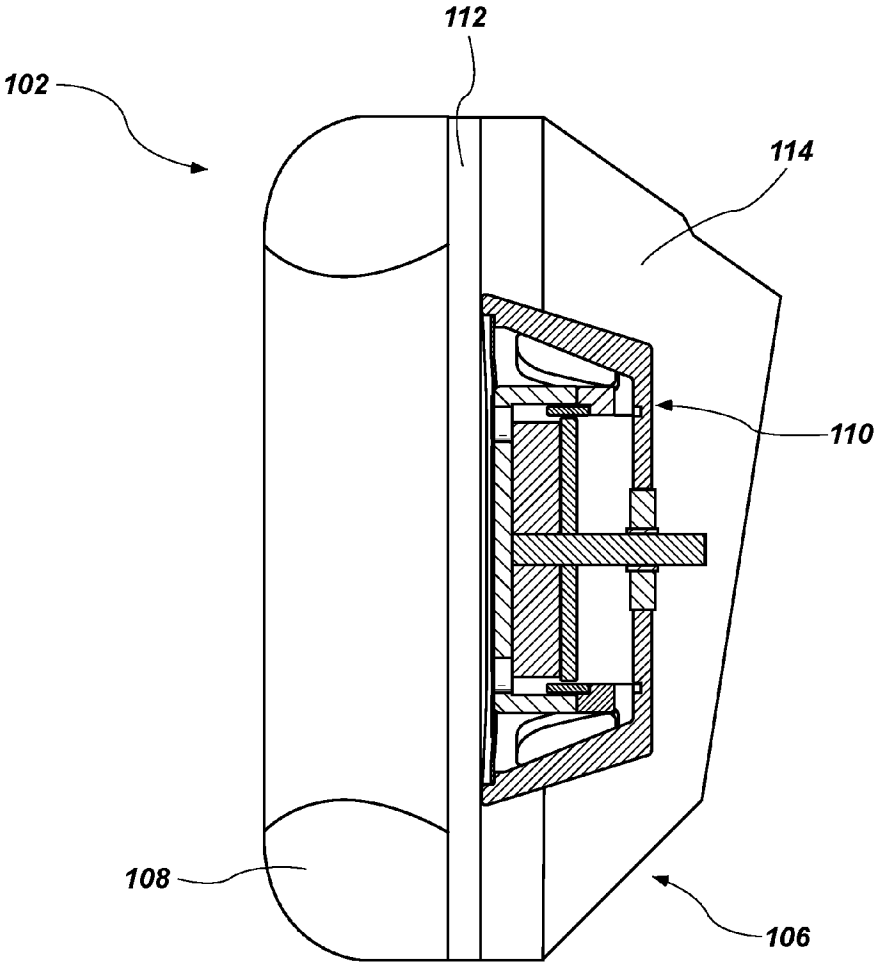
FIG. 4 is a cross-sectional view of an ear-cup assembly including the audio driver assembly of FIG. 1, in accordance with an embodiment of disclosure.

FIG. 4 is a simplified cross-sectional view illustrating the audio driver assembly 110 of FIG. 1 within an ear-cup assembly 102. The ear-cup assembly 102 may include an outer ear-cup housing 106 including at least two members assembled together around the audio driver assembly 110. As a non-limiting example, the outer ear-cup housing 106 may include a front member 112, and a back member 114 connected to the front member 112. The members of the outer ear-cup housing 106 (e.g., the front member 112, the back member 114, etc.) may each independently be formed of and include at least one of a metal material (e.g., a metal, a metal alloy, etc.) and a polymer material (e.g., a plastic), and may serve as a frame structure for the ear-cup assembly 102. The ear-cup assembly 102 may also include a cushion 108 attached to or otherwise carried on the outer ear-cup housing 106. The ear-cup assembly 102 may, alternatively, include the audio driver assembly 110' of FIG. 2 or the audio driver assembly 110" of FIG. 3 secured therein.

Figure 5:
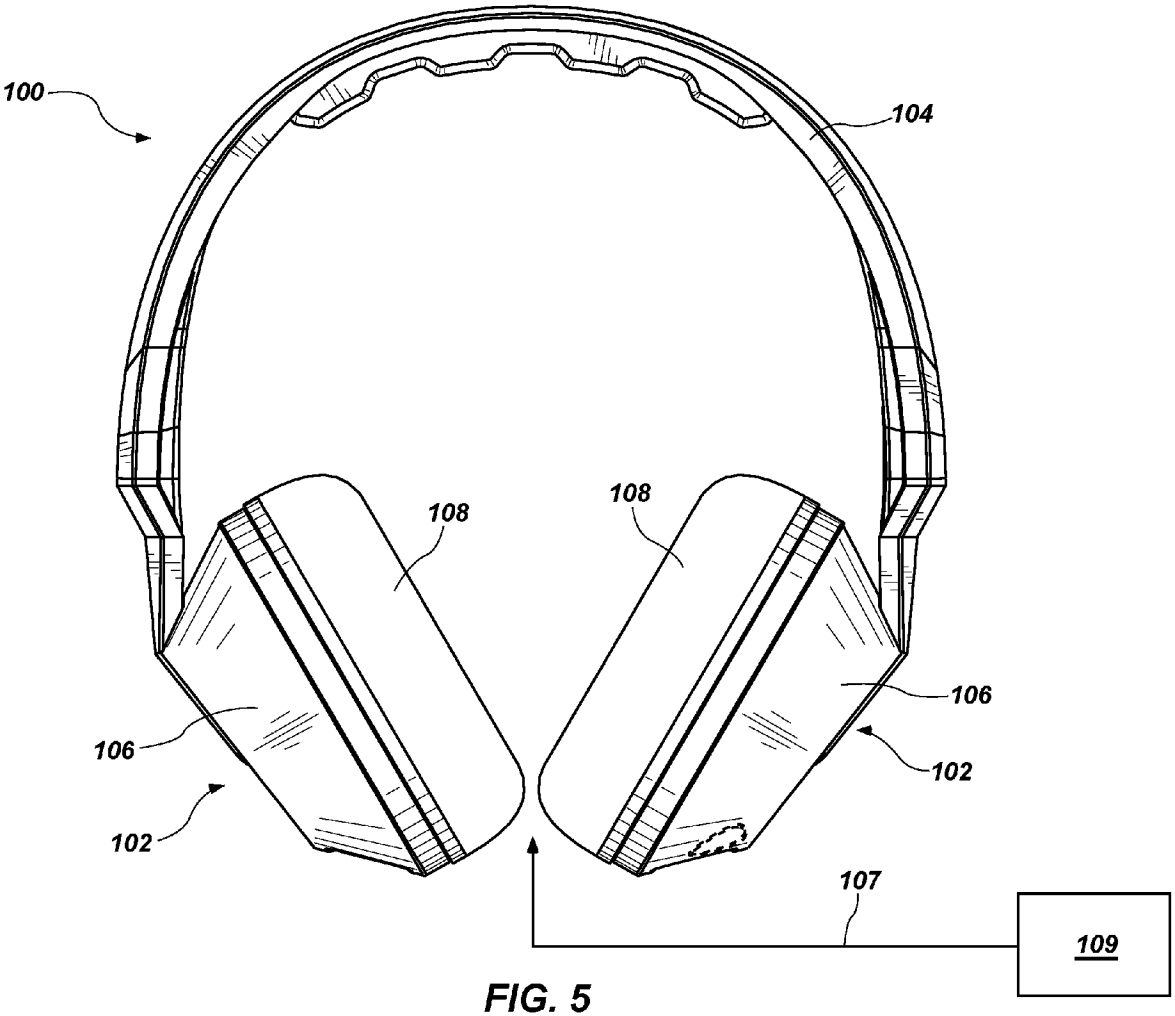
FIG. 5 is a simplified elevation view of a headphone including the ear-cup assembly of FIG. 4, in accordance with an embodiment of disclosure.

FIG. 5 is a simplified longitudinal view of a headphone 100 including two of the ear-cup assemblies 102 of FIG. 4, and a headband 104 connected to each of the ear-cup assemblies 102. The headband 104 may be configured to rest on the head of a user and to support the ear-cup assemblies 102 on or over the user's ears. The headphone 100 may be configured to receive an electronic audio signal from a media player 109 through a connection 107 (e.g., a wired connection, a wireless connection, etc.) between the headphone 100 and the media player 109. The media player 109 may comprise any device or system capable of producing an audio signal. By way of non-limiting example, the media player 109 may comprise a portable digital music player, a portable compact disc player, a portable cassette player, a mobile phone, a smartphone, a personal digital assistant (PDA), a radio (e.g., AM radio, FM radio, HD radio, satellite radio, etc.), a television, an ebook reader, a portable gaming system, a portable DVD player, a laptop computer, a tablet computer, a desktop computer, a stereo system, and/or other devices or systems that may be created hereafter.

While the disclosure is susceptible to various modifications and alternative forms, specific embodiments have been shown by way of example in the drawings and have been described in detail herein. However, the disclosure is not limited to the particular forms disclosed. Rather, the disclosure is to cover all modifications, equivalents, and alternatives falling within the scope of the disclosure as defined by the following appended claims and their legal equivalents.

What is claimed is:

1. An audio driver assembly, comprising:
- a driver housing; and
- an audio driver secured within the driver housing and comprising:
  - a magnet assembly comprising:
    - a permanent magnet;
    - a voice coil circumscribing the permanent magnet; and
    - a yoke cup at least partially surrounding the permanent magnet and the voice coil, and comprising:
      - a lower portion underlying a lower surface of the permanent magnet; and
      - an upper portion overlying an upper surface of the permanent magnet and at least partially extending over and surrounding peripheral sidewalls of each of the permanent magnet and the lower portion of the yoke cup;
  - a flexible diaphragm overlying the magnet assembly; and
  - a stabilizer extending through the driver housing and into the magnet assembly.

2. The audio driver assembly of claim 1, wherein at least a portion of the voice coil is located within a cavity at least partially defined by inner sidewalls of the upper portion of the yoke cup and the peripheral sidewalls of each of the permanent magnet and the lower portion of the yoke cup.

3. The audio driver assembly of claim 1, wherein the stabilizer longitudinally extends from a location outside of the driver housing to a lower surface of the upper portion of the yoke cup.

4. The audio driver assembly of claim 1, wherein the stabilizer is located adjacent central portions of each of the driver housing and the magnet assembly.

5. The audio driver assembly of claim 1, wherein the stabilizer is disposed within substantially aligned, centrally located apertures in the driver housing and the magnet assembly.

6. The audio driver assembly of claim 1, wherein the stabilizer is attached to at least one surface of the magnet assembly.

7. The audio driver assembly of claim 1, wherein the stabilizer is attached to at least one surface of the driver housing.

8. The audio driver assembly of claim 1, wherein the stabilizer comprises at least one of a metal material and a polymer material.

9. An audio driver assembly, comprising:
- a driver housing; and
- an audio driver secured within the driver housing and comprising:
  - a magnet assembly;
  - a flexible diaphragm overlying the magnet assembly;
  - a stabilizer extending through the driver housing and into the magnet assembly; and
  - a vibration dampener disposed laterally between the driver housing and the stabilizer, wherein at least a portion of the vibration dampener is located within an aperture extending through driver housing, and at least a portion of the stabilizer is located within another aperture extending through the vibration dampener.

10. The audio driver assembly of claim 9, wherein the vibration dampener comprises at least one of silicon, rubber, and foam.

11. The audio driver assembly of claim 9, wherein the vibration dampener comprises a ferrofluidic vibration dampener comprising:
- another magnet assembly adjacent the driver housing; and a ferrofluid between the another magnet assembly and the stabilizer.

12. A headphone, comprising:

an ear-cup housing; and an audio driver assembly disposed at least partially within the ear-cup housing, the audio driver assembly comprising:

a driver housing;

a flexible diaphragm suspended from the driver housing;

a magnet assembly underlying the diaphragm and comprising:

a permanent magnet;

a voice coil circumscribing the permanent magnet; and a yoke cup at least partially surrounding the permanent magnet and the voice coil; and a stabilizer extending through the driver housing and into the magnet assembly.

13. The headphone of claim 12, wherein the stabilizer is positioned within each of an aperture extending through the driver housing and another aperture at least partially extending through the permanent magnet of the magnet assembly.

14. The headphone of claim 12, wherein one end of the stabilizer terminates at a surface of an upper portion of the yoke cup and another end of the stabilizer terminates at a location beyond a lower boundary of the driver housing.

15. The headphone of claim 12, wherein the audio driver assembly further comprises a vibration dampener at least partially disposed between the driver housing and the stabilizer.

16. The headphone of claim 15, wherein the vibration dampener comprises:

another magnet assembly laterally adjacent the driver housing; and a ferrofluid laterally between the magnet assembly and the stabilizer.

17. A method of forming a headphone, comprising:

forming an audio driver assembly, the audio driver assembly comprising:

a driver housing;

a flexible diaphragm suspended from the driver housing;

a magnet assembly underlying the diaphragm and comprising:

a permanent magnet;

a voice coil circumscribing the permanent magnet; and a yoke cup at least partially surrounding the permanent magnet and the voice coil; and a stabilizer extending through the driver housing and into the magnet assembly; and attaching the audio driver assembly within an ear-cup housing.

* * * * *